US008393417B2

(12) United States Patent
Earles et al.

(10) Patent No.: US 8,393,417 B2
(45) Date of Patent: Mar. 12, 2013

(54) APPARATUS AND METHODS TO OPTIMIZE FLUID FLOW AND PERFORMANCE OF DOWNHOLE DRILLING EQUIPMENT

(75) Inventors: Ronald G. Earles, Houston, TX (US); Barry D. Calnan, Conroe, TX (US); Randy C. Ivey, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 238 days.

(21) Appl. No.: 12/745,676

(22) PCT Filed: Dec. 2, 2008

(86) PCT No.: PCT/US2008/085254

§ 371 (c)(1), (2), (4) Date: Jun. 1, 2010

(87) PCT Pub. No.: WO2009/073656

PCT Pub. Date: Jun. 11, 2009

(65) Prior Publication Data

US 2010/0300761 A1 Dec. 2, 2010

Related U.S. Application Data

(60) Provisional application No. 60/992,231, filed on Dec. 4, 2007.

(51) Int. Cl.
*E21B 17/18* (2006.01)
*E21B 17/10* (2006.01)

(52) U.S. Cl. .... 175/324; 175/76; 175/325.1; 175/325.2; 175/393

(58) Field of Classification Search ..... 166/241.1; 175/76, 323, 324, 325.1, 325.2, 393
See application file for complete search history.

(56) References Cited

U.S. PATENT DOCUMENTS

| | | | | |
|---|---|---|---|---|
| 2,973,996 | A * | 3/1961 | Self | 175/325.7 |
| 5,341,888 | A * | 8/1994 | Deschutter | 175/323 |
| 5,904,213 | A | 5/1999 | Caraway et al. | 175/393 |
| 6,446,737 | B1 | 9/2002 | Fontana et al. | 175/61 |
| 6,494,272 | B1 * | 12/2002 | Eppink et al. | 175/57 |
| 2004/0160858 | A1 | 8/2004 | Ciglenec et al. | 367/83 |
| 2005/0205250 | A1 | 9/2005 | Haugen et al. | 166/105 |
| 2006/0201711 | A1 | 9/2006 | Vail, III | 175/57 |

OTHER PUBLICATIONS

International Preliminary Report on Patentability; PCT/US08/85254; pp. 4, Jun. 16, 2010.
International Search Report and Written Opinion; PCT/US2008/085254; pp. 11, Jan. 26, 2009.

* cited by examiner

*Primary Examiner* — Brad Harcourt
(74) *Attorney, Agent, or Firm* — Baker Botts L.L.P.

(57) ABSTRACT

Sleeves, stabilizers and other well tools may be formed with fluid flow paths or channels extending through one or more blades disposed on the exterior portions of such well tools. The blades and associated fluid flow paths extending therethrough may allow optimum fluid flow rates and volumes to enhance lifting of formation cuttings and downhole debris along with cleaning exterior portions of the well tool and an associated rotary drill bit. Location, configuration, orientation and/or dimensions associated with such blades and associated fluid flow paths or channels may also be modified to provide an enlarged pad or contact surface on exterior portions of one or more blades while maintaining desired fluid flow rates and volumes over exterior portions of the well tool. Such pads or contact surfaces may have optimum surface areas for contacting adjacent portions of a wellbore during directional drilling of the wellbore.

18 Claims, 7 Drawing Sheets

APPARATUS AND METHODS TO OPTIMIZE FLUID FLOW AND PERFORMANCE OF DOWNHOLE DRILLING EQUIPMENT

CROSS REFERENCE TO RELATED APPLICATIONS

This application is a U.S. National Stage Application of International Application No. PCT/US2008/085254 filed Dec. 2, 2008, which designates the United States and claims the benefit of U.S. Provisional Patent Application Ser. No. 60/992,231, filed Dec. 4, 2007, the contents of which are hereby incorporated in their entirety by reference.

TECHNICAL FIELD

The present disclosure is related to sleeves and/or stabilizers associated with rotary drill bits and particularly optimizing fluid flow characteristics and/or performance of such sleeves and/or stabilizers along with associated downhole drilling equipment.

BACKGROUND OF THE DISCLOSURE

Various types of rotary drill bits, reamers, sleeves, stabilizers and other downhole tools may be used to form a borehole in the earth. Examples of such rotary drill bits include, but are not limited to, fixed cutter drill bits, drag bits, PDC drill bits, matrix drill bits, roller cone drill bits, rotary cone drill bits and rock bits used in drilling oil and gas wells. Cutting action associated with such drill bits generally requires weight on bit (WOB) and rotation of associated cutting elements into adjacent portions of a downhole formation. Drilling fluid may also be provided to perform several functions including washing away formation materials and other downhole debris from the bottom of a wellbore, cleaning associated cutting elements and cutting structures and carrying formation cuttings and other downhole debris upward to an associated well surface.

Some prior art sleeves and stabilizers have been formed with blades extending from a generally hollow, elongated cylindrical body. One or more gage pads may be formed on exterior portions of such blades. See for example U.S. Pat. Nos. 5,967,246, 5,992,547, 6,092,613 and 6,129,161. British Patent GB 2424434 may also be of interest.

SUMMARY OF THE DISCLOSURE

Various types of downhole tools associated with drilling wellbores may be formed in accordance with teachings of the present disclosure to optimize surface area of selected exterior portions of such downholes and to optimize fluid flow (hydraulics) of drilling fluids and other downhole fluids. For some embodiments a plurality of fluid flow paths may be formed on exterior portions of a generally cylindrical body in accordance with teachings of the present disclosure. For example, sleeves and/or near bit stabilizers may be formed with a plurality of blades having fluid flow paths or channels extending therethrough. The blades and associated fluid flow paths or channels may have symmetrical configurations relative to each and/or an associated generally cylindrical body or asymmetrical configurations relative to each other and/or the associated generally cylindrical body.

Respective pads or contact surfaces may be disposed on exterior portions of each blade. Associated fluid flow paths or channels may be designed in accordance with teachings of the present disclosure to maximize surface area of such pads or contact surfaces, optimize flow of drilling fluids and other downhole fluids and/or reduce wear at various locations on the associated blades and/or pads. The width or thickness of each blade, associated pad or contact surfaces and associated fluid flow paths may also be optimized to enhance downhole drilling performance of an associated rotary drill bit and/or associated directional drilling equipment.

Forces associated with exterior portions of a downhole tool or well tool contacting adjacent portions of a wellbore may be very large. Such forces may exceed compression strength of adjacent formation materials. One aspect of the present disclosure may include forming a downhole tool or well tool having one or more exterior portions with increased surface area to decrease the possibility of adjacent downhole formation materials failing when contacted by the one or more exterior portions of the downhole tool or well tool. Such exterior portions may sometimes be referred to as "pads" or "contact surfaces".

Examples of such downhole tools having exterior portions which may contact adjacent portions of a wellbore and/or well tools include, but are not limited to, sleeves and stabilizers associated with rotary drill bits used to form directional wellbores. Some rotary steering systems and other types of directional drilling systems often include a near bit stabilizer having one or more exterior portions which functions as a fulcrum to change the direction of an associated wellbore. Such stabilizers are particularly important when used with "Point the Bit" rotary steering systems. If adjacent formation material fails when contacted by exterior portions of a near bit stabilizer, the near bit stabilizer may no longer provide a satisfactory fulcrum to direct an associated rotary drill bit to form a desired directional wellbore.

One aspect of the present disclosure may include, but is not limited to, identifying critical fluid flow areas or locations on associated downhole tools. Various types of coatings may be placed on exterior portions of the blades and associated generally cylindrical body to minimize balling of formation cuttings and other types of downhole debris. Various surfaces associated with the blades, pads, contact surfaces and/or fluid flow paths may be tapered and/or rounded to minimize or eliminate potential buildup of formation cuttings and other downhole debris that would restrict or block desired fluid flow.

Forming fluid flow paths through one or more blades of a near bit stabilizer in accordance with teachings of the present disclosure may allow optimizing the location, configuration and area of associated pad or contact surfaces to substantially enhance stabilization of an associated rotary drill bit. Such fluid flow paths may also be formed to optimize fluid flow from the bottom or end of a wellbore to an associated well surface or wellhead. Near bit stabilizers may be designed in accordance with teachings of the present disclosure to reduce wear and erosion of associated blades while forming a wellbore, particularly non-vertical and non-straight wellbores. Near bit stabilizers incorporating teachings of the present disclosure may improve steerability of an associated rotary drill bit and/or improve ability of the associated rotary drill bit to form a wellbore with a more uniform inside diameter.

One aspect of the present disclosure may include designing downhole tools with blades having generally helical configurations, spiral shaped configurations or any other configuration satisfactory for use with each downhole tool. Fluid flow paths may be disposed between adjacent blades and may extend through one or more of the blades to establish generally uniform and generally upward fluid flow from the bottom or end of a wellbore to optimize removable of formation cuttings and other downhole debris. The configuration of such blades and respective fluid flow paths disposed between the blades and disposed through one or more of the blades may also be optimized in accordance with teachings of the present disclosure to minimize fluid pressure drops and to maintain desired velocity of fluid flow. For some applications the blades may have exterior configurations which cooperate with other components of an associated bottom hole assembly and/or an associated rotary drill bit to improve steerability, particularly during formation of non-vertical or non-straight wellbores.

EZ-Pilot™ Rotary Steerable Systems available from Halliburton Company and rotary steerable systems available from other companies often use a near bit stabilizer to provide a fulcrum to change direction of an associated wellbore. When appropriate force is applied to a near bit stabilizer, exterior portions of the stabilizer may contact adjacent portions of an associated wellbore to provide a fulcrum. Resulting reaction forces may then act on an attached rotary drill bit, much like a lever, to point the rotary drill bit in a desired direction relative to recently formed portions of a wellbore. Forces applied to the stabilizer may thus be used to "steer" a rotary drill bit while forming a directional wellbore. A near bit stabilizer may be one of the more important components of a "Point the Bit System".

One of the considerations with a Point the Bit System may be that forces on an associated stabilizer are sometimes very high and may sometimes be higher than compressive strength of an adjacent formation. When adjacent formation materials fails, the near bit stabilizer may not produce a desired direction response by the associated rotary drill bit. Wear may be another concern when large forces are applied to a stabilizer during contact with an adjacent downhole formation. Such wear may alter directional performance characteristics of the stabilizer. Teachings of the present disclosure may be used to optimize design of a stabilizer to prevent formation failure, minimize wear on exterior portions of the stabilizer and/or eliminate or substantially reduce side cutting by the stabilizer.

One aspect of the present disclosure may include increasing the surface area of exterior portions of a well tool such as a sleeve or stabilizer without reducing fluid flow around and over exterior portions of the well tool. Increasing the surface area of such exterior portions may also increase wear resistance and reduce friction loads. Increasing the surface area of pads or other contact surfaces may more effectively spread out loads at fulcrum points associated with steering a rotary drill bit and thus decrease the likelihood of failing an adjacent formation.

Forming one or more fluid flow paths extending through a blade in accordance with teachings of the present disclosure may allow enlarging exterior portions of such blades which contact adjacent portions of a wellbore without decreasing fluid flow between exterior portions of the well tool and adjacent portions of the wellbore. Providing such fluid flow paths through a blade may sometimes be referred to as "porting." Forming one or more fluid flow paths through a blade in accordance with teachings of the present disclosure may result in maintaining desired fluid flow rates between exterior portions of an associated well tool and adjacent interior portions of a wellbore. Enlarging select exterior portions of the well tool may reduce friction, and reduce possible hanging or sticking of the well tool.

Additional features, steps and/or benefits of the present disclosure will be discussed in the Detailed Description and/or Claims. This Summary is not intended to be a comprehensive listing of all features, steps and/or benefits of the present disclosure.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1:
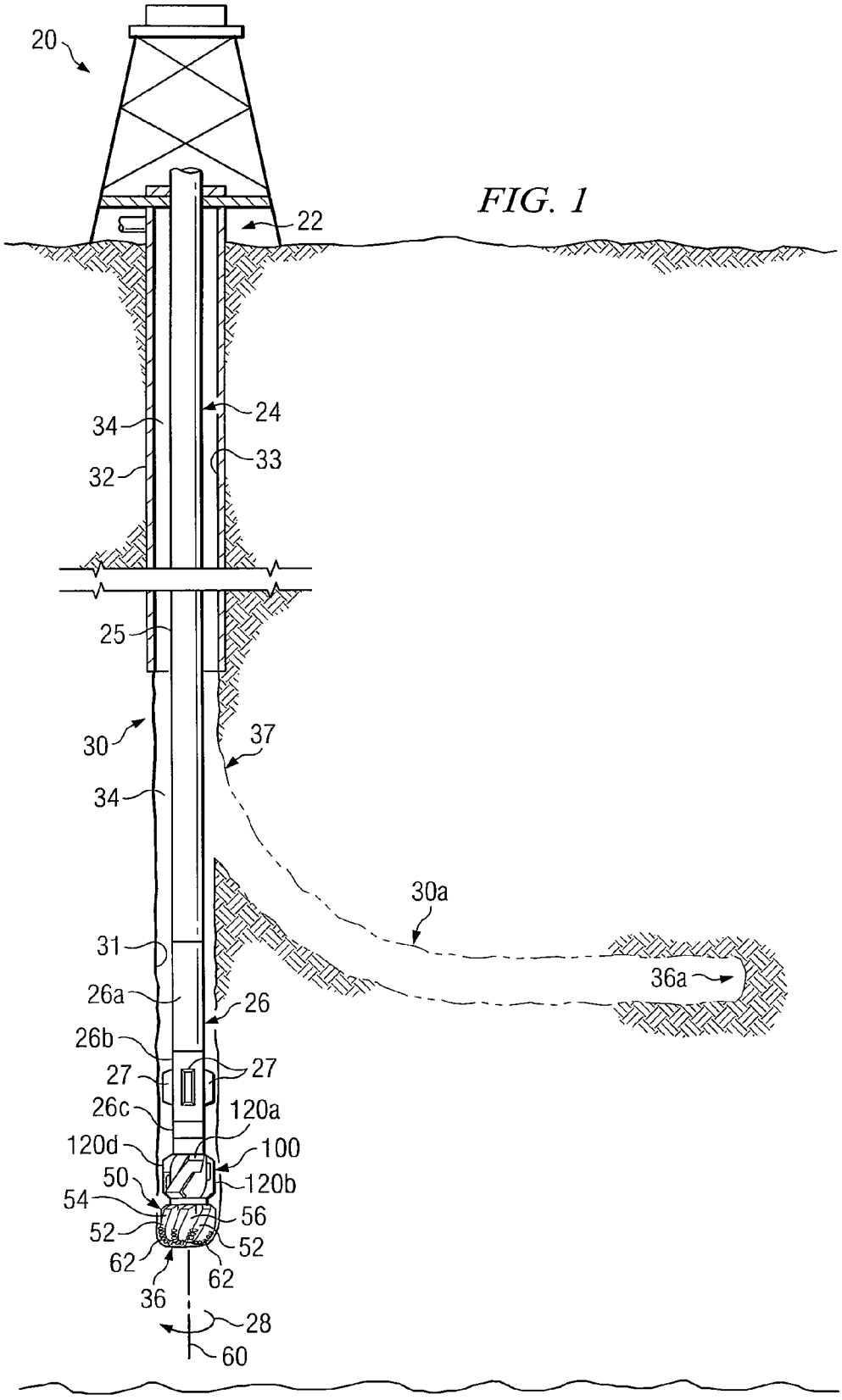
FIG. 1 is a schematic drawing in section and in elevation with portions broken away showing examples of wellbores which may be formed by a rotary drill bit and an associated stabilizer or sleeve incorporating teachings of the present disclosure.

Various embodiments of the disclosure and its advantages may be understood by reference to FIGS. 1-8 wherein like numbers refer to same and like parts.

The term "bottom hole assembly" or "BHA" may be used in this application to describe various components and assemblies disposed proximate a rotary drill bit at the downhole end of a drill string. Examples of components and assemblies (not expressly shown) which may be included in a bottom hole assembly include, but are not limited to, bent subs, downhole drilling motors, reamers, stabilizers, rotary steering tools and downhole instruments. Components and assemblies located proximate an associated rotary drill bit may sometimes be referred to as "near bit" such as near bit reamers, near bit stabilizers or near bit sleeves.

A bottom hole assembly may also include various types of well logging tools (not expressly shown) and other downhole tools associated with directional drilling of a wellbore. Examples of such logging tools and/or directional drilling tools may include, but are not limited to, acoustic, neutron, gamma ray, density, photoelectric, nuclear magnetic resonance, measuring while drilling (MWD) tools and/or other commercially available well tools.

The terms "blade" and "blades" may be used in this application to include, but are not limited to, various types of projections extending outwardly from a well tool. Such well tools may have generally cylindrical bodies with associated blades extending radially therefrom. Blades formed in accordance with teachings of the present disclosure may have a wide variety of configurations including, but not limited to, helical, spiraling, tapered, converging, diverging, symmetrical, and/or asymmetrical. Such blades may also be used on well tools which do not have a generally cylindrical body.

The terms "cutting element" and "cutting elements" may be used in this application to include, but are not limited to, various types of cutters, compacts, buttons, inserts and gage cutters satisfactory for use with a wide variety of rotary drill bits. Impact arrestors may be included as part of the cutting structure on some types of rotary drill bits and may sometimes function as cutting elements to remove formation materials from adjacent portions of a wellbore. Polycrystalline diamond compacts (PDC) and tungsten carbide inserts are often used to form cutting elements. Various types of other hard, abrasive materials may also be satisfactorily used to form cutting elements.

The terms "downhole" and "uphole" may be used in this application to describe the location of various components of a bottom hole assembly and associated rotary drill bit relative to portions of the rotary drill bit which engage the bottom or end of a wellbore to remove adjacent formation materials. For example an "uphole" component may be located closer to an associated drill string as compared to a "downhole" component which may be located closer to the bottom or end of the wellbore.

The terms "contact surface" and/or "pad" as used in this application may include a gage, gage segment, gage portion or any other exterior portion of a blade incorporating teachings of the present disclosure. Gage pads disposed on a rotary drill bit may often contact adjacent portions of a wellbore formed by the associated rotary drill bit. A gage pad may include one or more layers of hardfacing material. Exterior portions of blades and/or associated contact surfaces may be disposed at various angles, either positive, negative or parallel, relative to adjacent portions of a wellbore. One or more contact surfaces may be disposed on a blade in accordance with teachings of the present disclosure.

The term "rotary drill bit" may be used in this application to include various types of fixed cutter drill bits, drag bits, matrix drill bits, steel body drill bits, roller cone drill bits, rotary cone drill bits and rock bits operable to form a wellbore extending through one or more downhole formations. Rotary drill bits and associated components formed in accordance with teachings of the present disclosure may have many different designs, configurations and/or dimensions.

The terms "sleeve" and "stabilizer" may be used in this application to include, but are not limited to, various types of downhole tools often having a generally cylindrical body operable to be attached to a drill string, a bottom hole assembly and/or a rotary drill bit. Sleeves and/or stabilizers incorporating teachings of the present disclosure may sometimes be disposed proximate an associated rotary drill bit. Such sleeves and stabilizers may sometimes be referred to as "near bit sleeves" or "near bit stabilizers." Some sleeves formed in accordance with teachings of the present disclosure may sometimes be referred to as "slickbore bit sleeves."

Sleeves, stabilizers and other downhole tools formed in accordance with teachings of the present disclosure may be disposed at various locations in a drill string and/or an associated bottom hole assembly. The present disclosure is not limited to near bit sleeves or near bit stabilizers.

Teachings of the present disclosure may be used to optimize the design of various features of a stabilizer, sleeve, other well tools or other downhole tools including, but not limited to, the number of blades, dimensions and configuration of each blade along with the configuration, dimensions, location and/or orientation of fluid flow paths or channels extending through one or more blades. The number, dimensions, configuration, and/or orientation of one or more fins or supporting structures disposed between exterior portions of an associated generally cylindrical body and interior portions of a blade may be varied in accordance with teachings of the present disclosure. The number, location, orientation, dimensions and/or configurations of one or more contact surfaces disposed on exterior portions of each blade may be varied in accordance with teachings of the present disclosure.

Various computer programs and computer models may be used to design contact surfaces, gage pads, compacts, cutting elements, blades and/or associated rotary drill bits. Examples of such methods and systems which may be used to design and evaluate performance of cutting elements and rotary drill bits are shown in copending U.S. patent applications entitled "Methods and Systems for Designing and/or Selecting Drilling Equipment Using Predictions of Rotary Drill Bit Walk," application Ser. No. 11/462,898, filing date Aug. 7, 2006; copending U.S. patent application entitled "Methods and Systems of Rotary Drill Bit Steerability Prediction, Rotary Drill Bit Design and Operation," application Ser. No. 11/462,918, filed Aug. 7, 2006 and copending U.S. patent application entitled "Methods and Systems for Design and/or Selection of Drilling Equipment Based on Wellbore Simulations," application Ser. No. 11/462,929, filing date Aug. 7, 2006. The previous copending patent applications and any resulting U.S. patents are incorporated by reference in this application.

Figure 2:
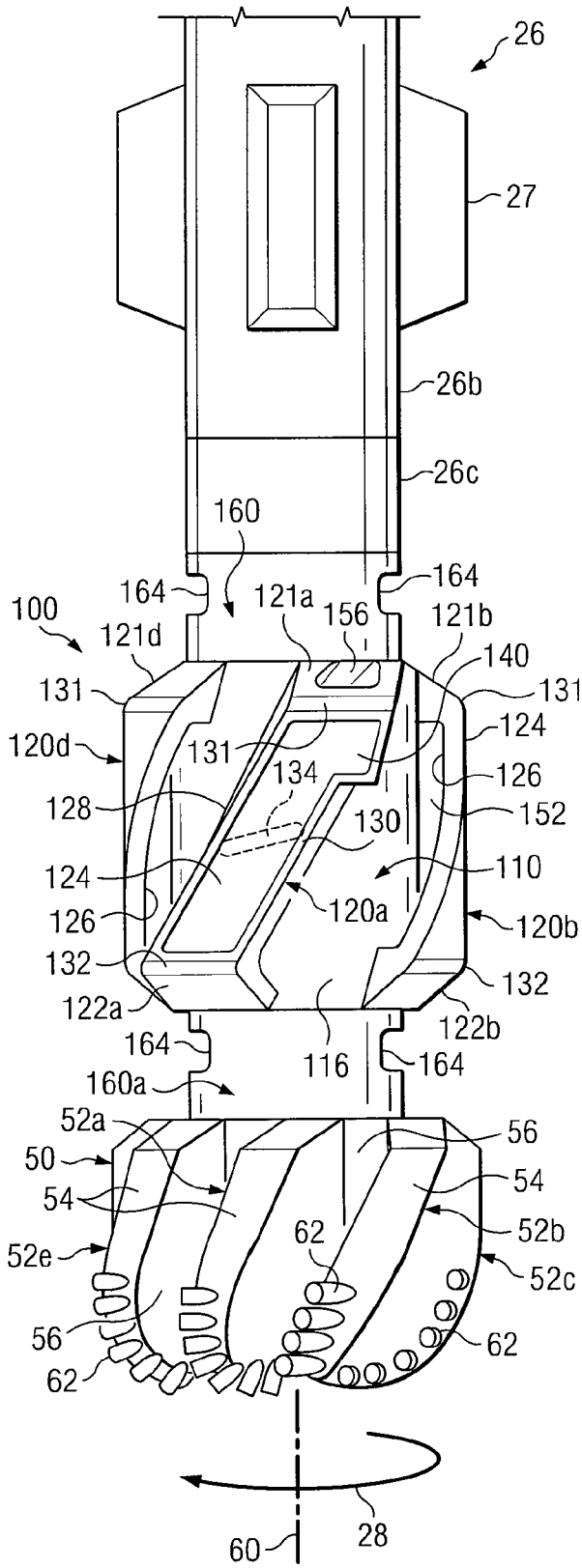
FIG. 2 is a schematic drawing in elevation with portions broken away of the stabilizer and associated rotary drill bit of FIG. 1.

Various aspects of the present disclosure may be described with respect to rotary drill bit 50 as shown in FIGS. 1 and 2 and sleeves or stabilizers 100 and 100*a* as shown in FIGS. 1-8. Rotary drill bit 50 may also be described as a fixed cutter drill bit. However, teaching of the present disclosure may be used to design, manufacture and use a wide variety of well tools and downhole tools. The present disclosure is not limited to sleeves or stabilizers.

Various aspects of the present disclosure may be used to design a wide variety of well tools and downhole tools having one or more blades Roller cone or rotary cone drill bits may also be used with various well tools and downhole tools incorporating teachings of the present disclosure to optimize downhole drilling performance. The scope of the present disclosure is not limited to rotary drill bit 50 or stabilizers 100 and 100*a*.

FIG. 1 is a schematic drawing in elevation and in section with portions broken away showing examples of wellbores or bore holes which may be formed by rotary drill bits and sleeves or stabilizers incorporating teachings of the present disclosure. Various aspects of the present disclosure may be described with respect to drilling rig 20 rotating drill string 24, attached bottom hole assembly 26 including sleeve or stabilizer 100 and associated rotary drill bit 50 to form a wellbore.

Various types of drilling equipment such as a rotary table, mud pumps and mud tanks (not expressly shown) may be located at well surface or well site 22. Drilling rig 20 may have various characteristics and features associated with a "land drilling rig." However, well tools and downhole tools incorporating teachings of the present disclosure may be satisfactorily used with drilling equipment located on offshore platforms, drill ships, semi-submersibles and drilling barges (not expressly shown).

For some applications rotary drill bit 50 may be attached to bottom hole assembly 26 proximate an extreme end of drill string 24. Drill string 24 may be formed from sections or joints of generally hollow, tubular drill pipe (not expressly shown). Bottom hole assembly 26 will generally have an outside diameter compatible with exterior portions of drill string 24 and inside diameter 31 of wellbore 30 formed by rotary drill bit 50.

Bottom hole assembly 26 may be formed from a wide variety of components. For example components 26*a*, 26*b* and 26*c* may be selected from the group including, but not limited to, drill collars, rotary steering tools, directional drilling tools and/or downhole drilling motors. The number of components such as drill collars and different types of components included in a bottom hole assembly may depend upon anticipated downhole drilling conditions and the type of wellbore which will be formed by drill string 24 and rotary drill bit 50.

Drill string 24 and rotary drill bit 50 may be used to form a wide variety of wellbores and/or bore holes such as generally vertical wellbore 30 and/or generally horizontal wellbore 30*a* as shown in FIG. 1. Wellbore 30 may be defined in part by casing string 32 extending from well surface 22 to a selected downhole location. Portions of wellbore 30 as shown in FIG. 1 which do not include casing 32 may be described as "open hole."

Various directional drilling techniques and associated components of bottom hole assembly 26 may be used to form horizontal wellbore 30*a*. For example one or more components of bottom hole assembly 26 may apply lateral forces to rotary drill bit 50 proximate kickoff location 37 to form horizontal wellbore 30*a* extending from generally vertical wellbore 30. Lateral movement of rotary drill bit 50 may result in part from increased contact between exterior portions of respective pads or contact surfaces 140 disposed on blades 120 of stabilizer 100 (See FIGS. 3 and 4) and adjacent portions of wellbore 30. Such lateral movement of rotary drill bit 50 may result in "building" or forming a wellbore with an increasing angle relative to vertical. Bit tilting may also occur during formation of horizontal wellbore 30*a*, particularly proximate kickoff location 37.

Various types of drilling fluid may be pumped from well surface 22 through drill string 24 to attached rotary drill bit 50. The drilling fluid may be circulated back to well surface 22 through annulus 34 defined in part by outside diameter 25 of drill string 24 and inside diameter 31 of wellbore 30. Inside diameter 31 may also be referred to as the "sidewall" of wellbore 30. Annulus 34 may also be defined by outside diameter 25 of drill string 24 and inside diameter 33 of casing string 32.

Formation cuttings may be formed by rotary drill bit 50 engaging formation materials proximate end 36 of wellbore 30. Drilling fluids may be used to remove formation cuttings and other downhole debris (not expressly shown) from end 36 of wellbore 30 to well surface 22. End 36 may sometimes be described as "bottom hole" 36. Formation cuttings may also be formed by rotary drill bit 50 engaging end 36*a* of horizontal wellbore 30*a*.

As shown in FIG. 1, drill string 24 may apply weight to and rotate rotary drill bit 50 to form wellbore 30. Inside diameter or sidewall 31 of wellbore 30 may correspond approximately with the combined outside diameter of blades 52 and associated gage pads 54 extending from rotary drill bit 50. Rate of penetration (ROP) of a rotary drill bit is typically a function of both weight on bit (WOB) and revolutions per minute (RPM). For some applications a downhole motor (not expressly shown) may be provided as part of bottom hole assembly 26 to also rotate rotary drill bit 50. The rate of penetration of a rotary drill bit is generally stated in feet per hour.

In addition to rotating and applying weight to rotary drill bit 50, drill string 24 may provide a conduit for communicating drilling fluids and other fluids from well surface 22 to drill bit 50 at end 36 of wellbore 30. Some drilling fluids may sometimes be referred to as drilling mud. Drilling fluids or other fluids flowing through drill string 24 may be directed to respective nozzles (not expressly shown) provided in rotary drill bit 50.

FIG. 2 is schematic drawings showing additional details of rotary drill bit 50 and bottom hole assembly 26 which may include sleeve or stabilizer 100 incorporating teachings of the present disclosure. Rotary drill bit 50 may include a plurality of blades 52 extending from an associated bit body. For some applications the bit body may be formed in part from a matrix of very hard materials associated with rotary drill bits. For other applications the bit body may be machined from various metal alloys satisfactory for use in drilling wellbores in downhole formations. Examples of matrix type drill bits are shown in U.S. Pat. Nos. 4,696,354 and 5,099,929.

An enlarged bore or cavity (not expressly shown) may be disposed in the bit body to communicate drilling fluids from drill string 24 to one or more nozzles. Respective fluid flow paths (sometimes referred to as "junk slots") 56 may be formed between adjacent blades 52. Fluid flow paths 56 may have a wide variety of configurations including, but not limited to, helical, spiraling, tapered, converging, diverging, symmetrical, and/or asymmetrical. For some applications blades 52 may spiral or extend at an angle relative to associated bit rotational axis 60.

A plurality of cutting elements 62 may be disposed on exterior portions of each blade 52. For some applications each cutting element 62 may be disposed in a respective socket or pocket formed on exterior portions of associated blades 52. Impact arrestors and/or secondary cutters (not expressly shown) may also be disposed on each blade 52.

Cutting elements 62 may include respective substrates (not expressly shown) with respective layers (not expressly shown) of hard cutting material disposed on one end of each respective substrate. Each substrate may have various configurations and may be formed from tungsten carbide or other materials associated with forming cutting elements for rotary drill bits. For some applications cutting layers may be formed from substantially the same hard cutting materials. For other applications cutting layers may be formed from different materials.

Various features and parameters associated with rotary drill bit 50 may include, but are not limited to, location and configuration of blades 52, junk slots 56, cutting elements 62 and/or respective gage portions or gage pads 54 formed on each blade 52. For some applications gage cutters (not expressly shown) may also be disposed on each blade 52. Additional information concerning gage pads, gage cutters and/or hard cutting materials may be found in U.S. Pat. Nos. 7,083,010, 6,845,828, and 6,302,224. Such features and parameters of rotary drill bit 50 may be used to design and/or modify various features and parameters of associated stabilizers 100 and/or 100*a* in accordance with teachings of the present disclosure including, but not limited to, the number, configuration, and/or dimensions of associated blades 120, contact surfaces or pads 140 and respective fluid flow paths 150.

Rotary drill bit 50 may often be substantially covered by a mixture of drilling fluid, formation cuttings and other downhole debris while drill string 24 rotates rotary drill bit 50. Drilling fluid exiting from one or more nozzles may be directed to flow generally toward end or bottom 36 of wellbore 30, to then flow under and around lower portions of rotary drill bit 50 and to next flow generally uphole between adjacent blades 52.

The number, location and configuration of blades 120 and respective fluid flow paths 150 disposed on exterior portions of sleeves 100 and 100*a* may be designed and manufactured in accordance with teachings of the present disclosure to optimize drilling fluid flow from between blades 52 disposed on associated rotary drill bit 50. One of the features of the present disclosure may include designing at least one contact surface or pad on exterior portions of sleeves 100 and/or 100*a* based on parameters such as blade length, blade width, blade spiral, axial taper, radial taper and/or other parameters associated with sleeves 100 and 100*a* and/or associated rotary drill bit 50.

For some embodiments the nominal diameter of sleeve 100 or 100*a* may be approximately equal to the nominal diameter or gage diameter of an associated rotary drill bit. For other embodiments the nominal diameter of sleeve 100 or 100*a* may be less than the gage diameter of an associated rotary drill bit. A well tool formed in accordance with teachings of the present disclosure may have a reduced diameter or "under gage" diameter to minimize problems associated with retrieving an associated bottom hole assembly and rotary drill bit from the bottom or end of a wellbore. For some embodiments the nominal diameter of sleeves 100 and/or 100*a* may be one thirty-second (1/32"), one sixteenth (1/16") or one eighth (1/8") of an inch less than the nominal diameter of associated rotary drill bit 50. The length of sleeve 100 and/or 100*a* may also be varied as desired for each downhole application.

Rotary drill bits are generally rotated to the right during formation of a wellbore. See arrow 28 in FIGS. 1 and 2. The rotational axis 60 of rotary drill bit 50 will generally be aligned with longitudinal axis 108 (See FIG. 3) of cylindrical body 110 of sleeve 100 while forming straight portions of a wellbore with associated rotary drill bit 50.

Cutting elements and/or blades may be generally described as "leading" or "trailing" with respect to other cutting elements, blades and components disposed on exterior portions of an associated rotary drill bit, stabilizer, sleeve or other downhole tools. For example blade 52*a* of rotary drill bit 50 as shown in FIG. 2 may be generally described as leading blade 52*b* and may be generally described as trailing blade 52*e*. In the same respect cutting elements 62 disposed on blade 52*a* of rotary drill bit 50 may be described as leading corresponding cutting elements 62 disposed on blade 52*b*. Cutting elements 62 disposed on blade 52*a* may be generally described as trailing corresponding cutting elements 62 disposed on blade 52*e*. In a similar manner blade 120*a* of stabilizer 100 as shown in FIG. 2 may be generally described as leading blade 120*b* and trailing blade 120*d*.

Figure 3:
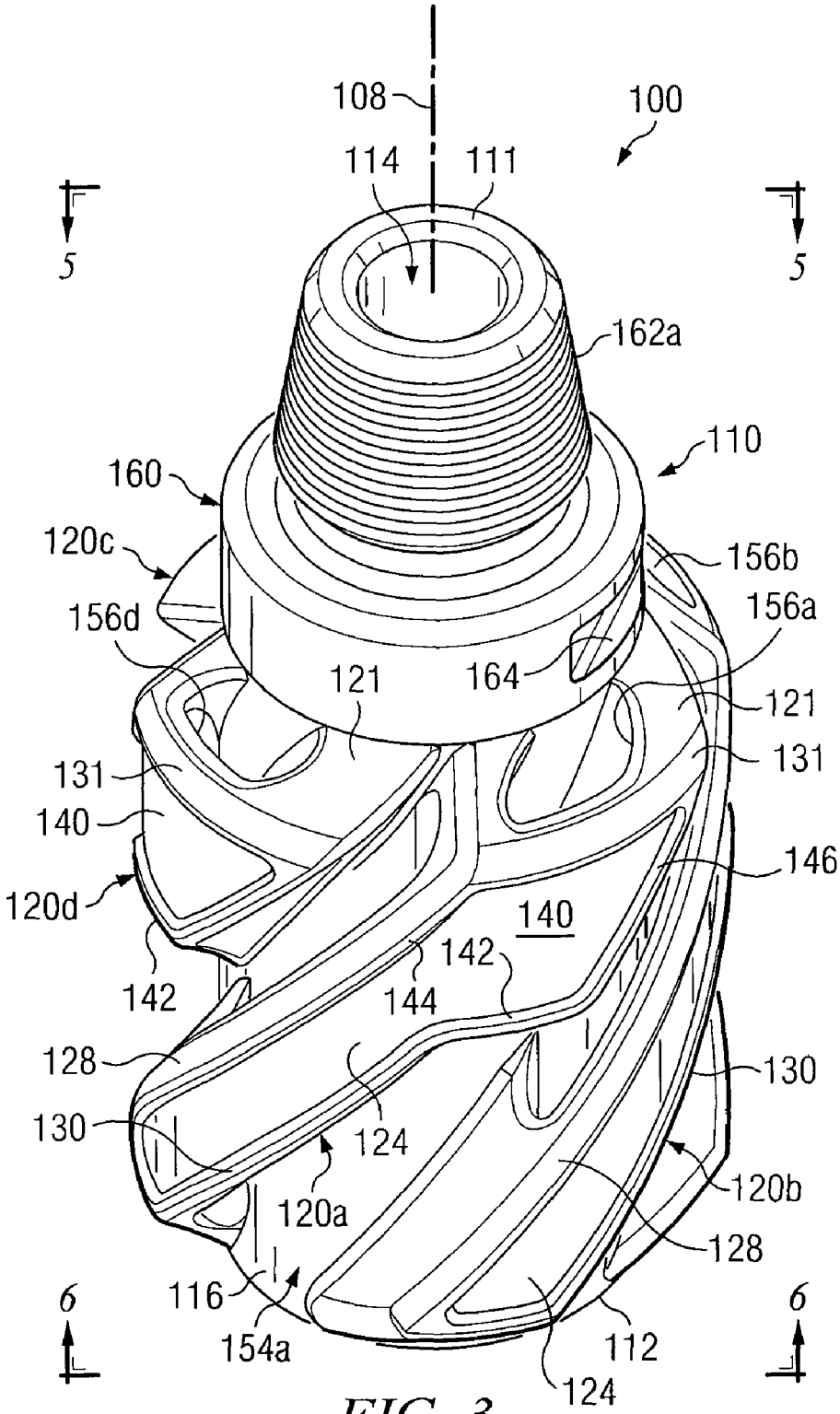
FIG. 3 is a schematic drawing showing an isometric view of the stabilizer of FIG. 1 incorporating teachings of the present disclosure.
Figure 4:
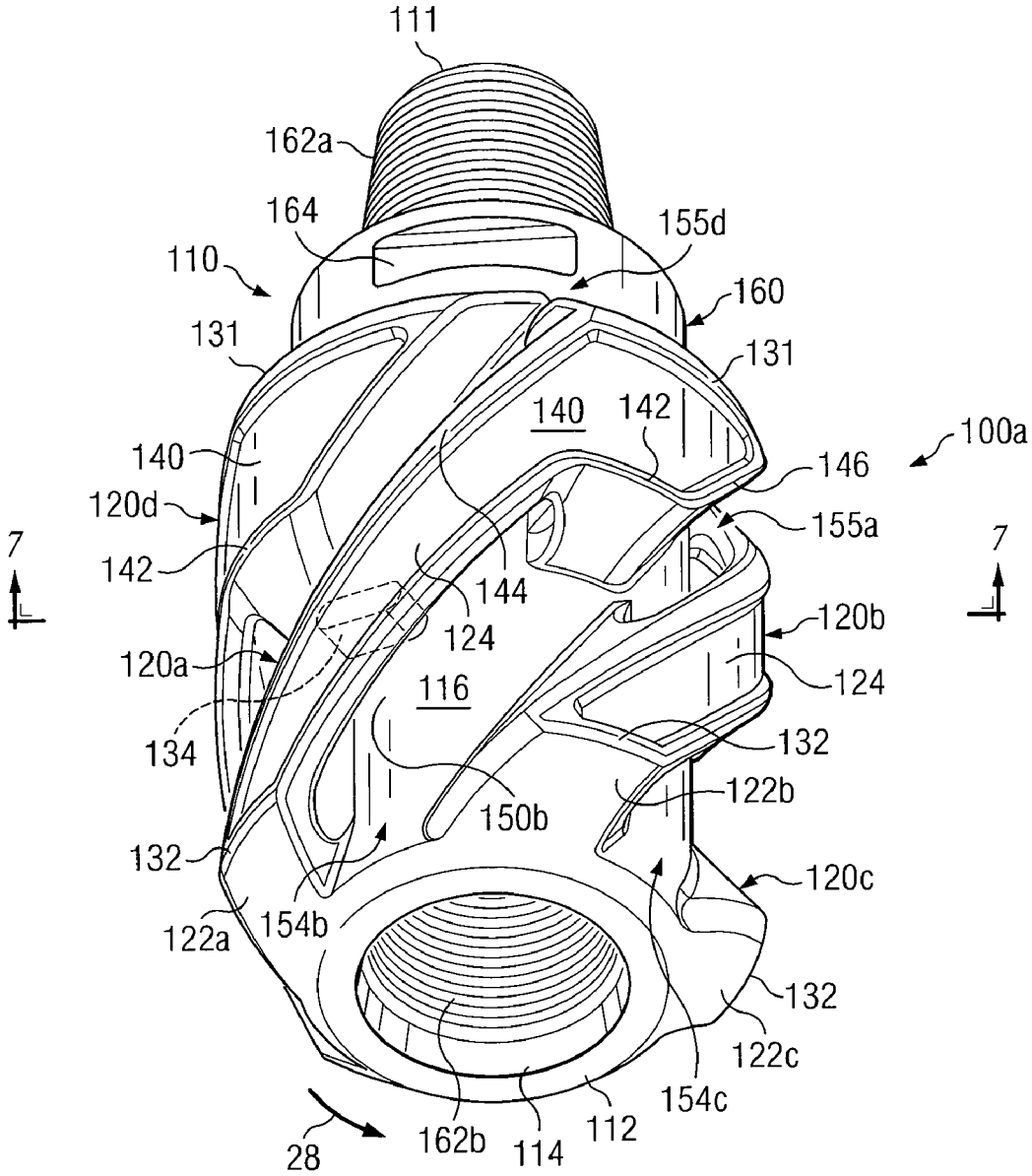
FIG. 4 is a schematic drawing showing another isometric view of the stabilizer of FIG. 1.
Figure 5:
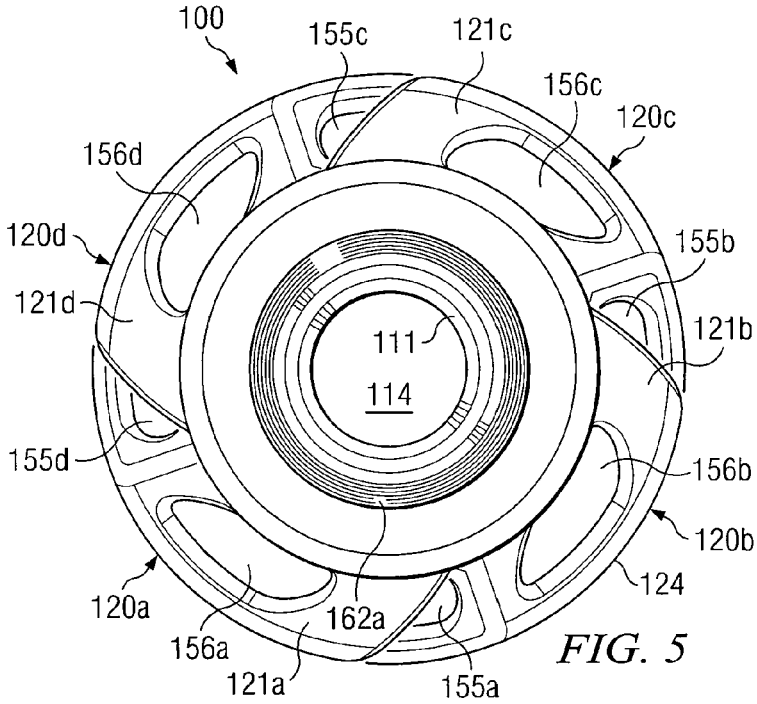
FIG. 5 is a schematic drawing showing an end view taken along lines 5-5 of FIG. 3.
Figure 6:
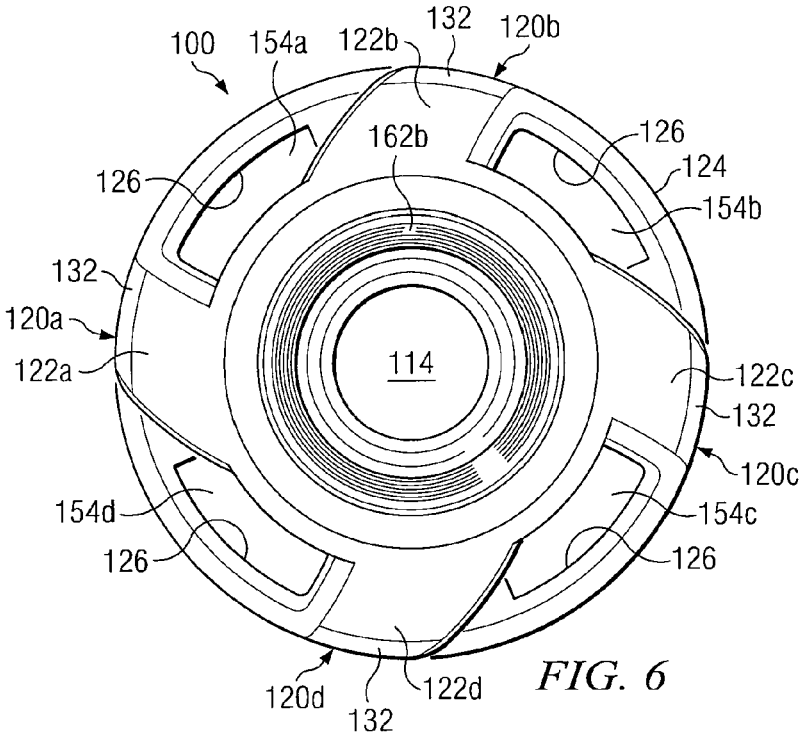
FIG. 6 is a schematic drawing showing an end taken along lines 6-6 of FIG. 3.
Figure 7:
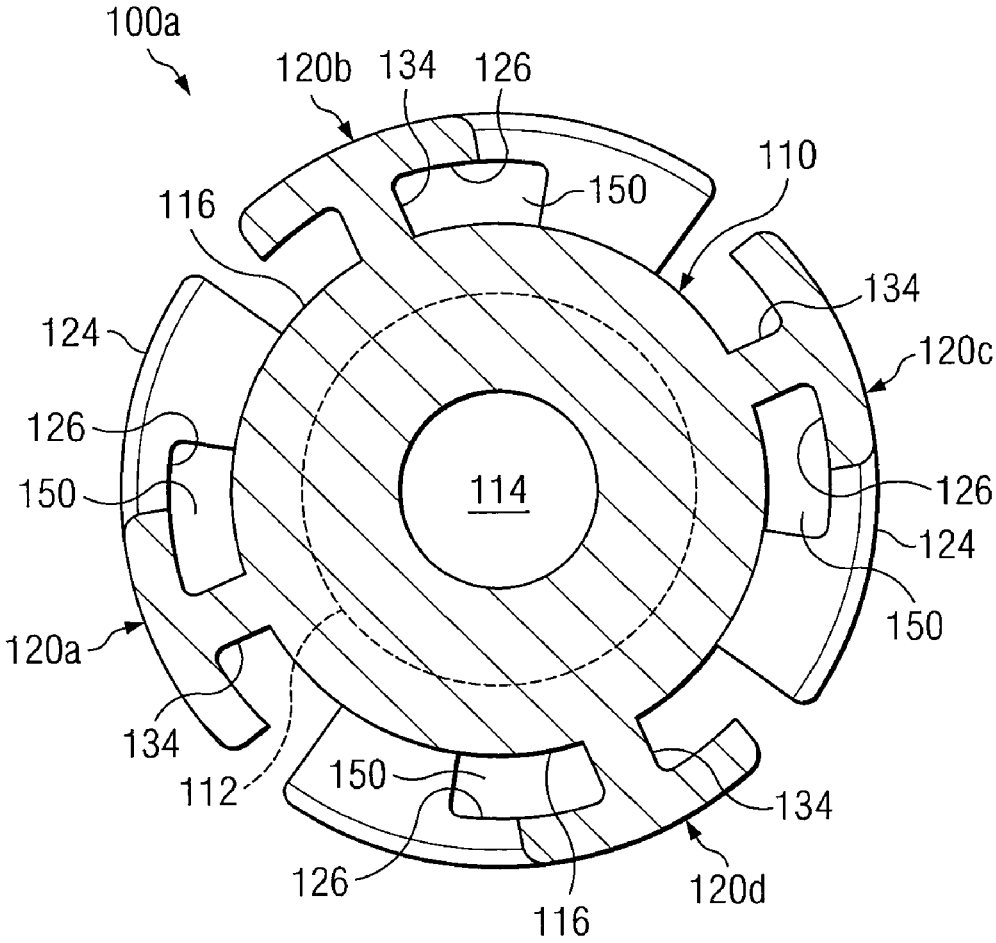
FIG. 7 is a schematic drawing in section taken along lines 7-7 of FIG. 4.
Figure 8:
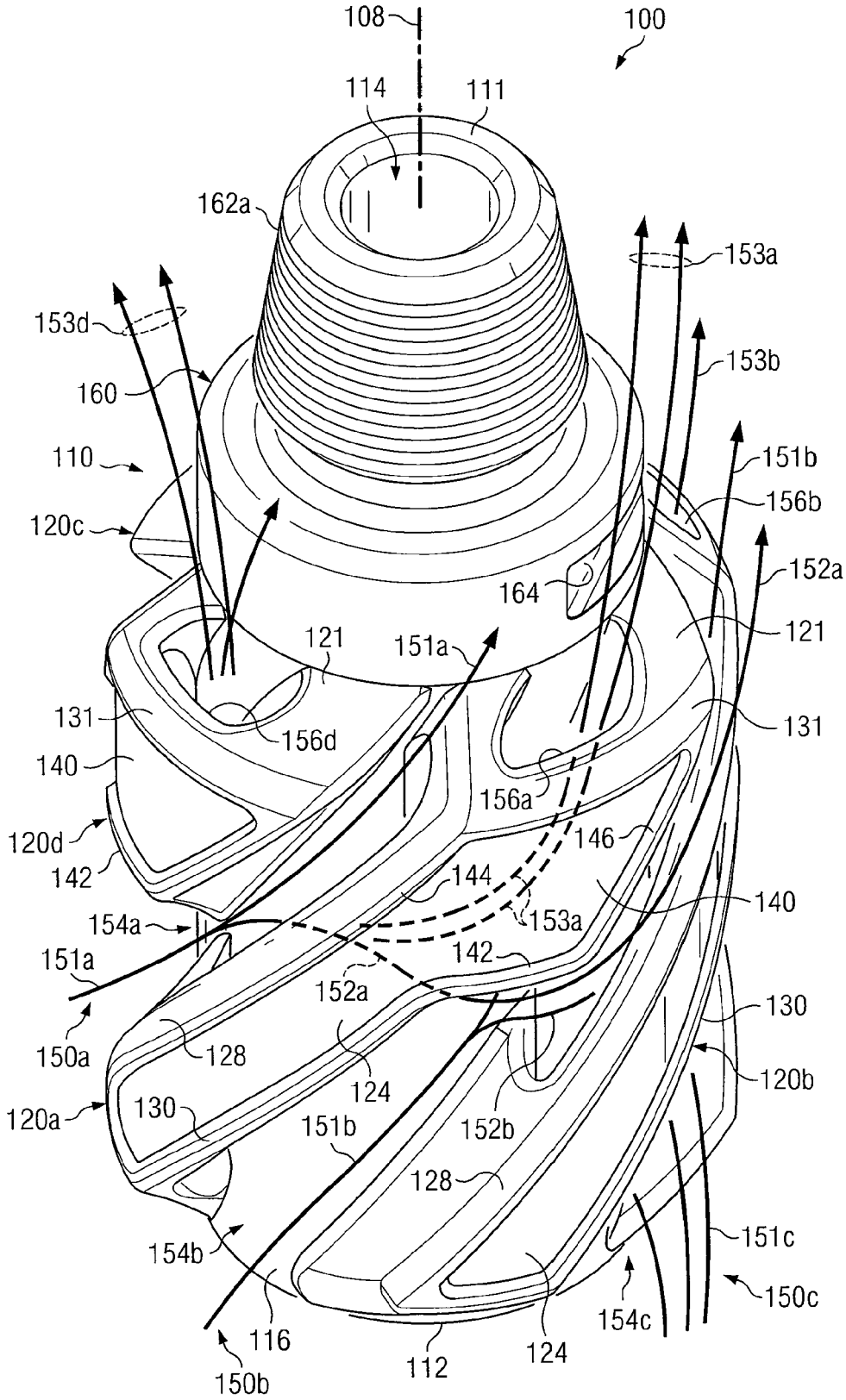
FIG. 8 is a schematic drawing showing one example of fluid flow paths or channels over exterior portions of a well tool incorporating teachings of the present disclosure

Stabilizer 100 as shown in FIGS. 1, 2, 3, 5, 6 and 8 and stabilizer 100*a* as shown in FIGS. 4 and 7 represent examples of well tools and/or downhole tools which may be formed in accordance with teachings of the present disclosure. Stabilizer or sleeve 100 may include generally cylindrical body 110 having first end 111 and second end 112 with longitudinal passageway 114 extending therethrough. A plurality of blades 120 may be disposed on and extend from exterior surface 116 of generally cylindrical body 110. Stabilizer or sleeve 100*a* may include cylindrical body 110 and other components similar to stabilizer 100.

For some embodiments sleeves 100 and 100*a* may have four (4) respective blades 120. For other applications three (3) blades may be formed on exterior portions of a downhole tool in accordance with teachings of the present disclosure. Downhole tools associated with forming larger diameter wellbores may have five (5) or more blades incorporating teachings of the present disclosure.

Upper portion 160 of stabilizers 100 and 100*a* may sometimes be described as a tool joint having a plurality of API drill pipe threads 162*a* disposed thereon. Upper portion 160*a* of rotary drill bit 50 may be a similar tool joint with similar API drill pipe threads disposed thereon. Upper portion 160 may also sometimes be referred to as the "pin end" of stabilizers 100 and 100*a*. Upper portion 160*a* of rotary drill bit 50 may also sometimes be referred to as a "pin end." A pair of slots 164 may be disposed in upper portion 160 proximate API threads 162*a*. A similar pair of slots 164 may be disposed in upper portion 160*a*.

A plurality of API drill pipe threads 162*b* may also be disposed within longitudinal passageway 114 proximate second end 112 of generally cylindrical body 110. Second end 112 may sometimes be described as the "box end" of stabilizer 100. API drill pipe threads 162*a* may be sized to be releasably engaged with corresponding API drill pipe threads (not expressly shown) formed in adjacent portions of bottom hole assembly component 26*c*. API drill pipe threads 162*b* may be sized to be releasably engaged with corresponding API drill pipe threads (not expressly shown) formed on adjacent upper portion or tool joint 160*a* of rotary drill bit 50.

For some applications general cylindrical body 110 and other components associated with sleeve 100 or sleeve 100*a* may be formed using metal casting techniques. However, a wide variety of metal working techniques associated with manufacture of well tools may be used to form sleeves 100 and/or 100*a*. For other applications upper portion 160 and second end or box end 112 may be formed on a generally hollow metal shank (not expressly shown). The hollow metal shank may be formed from materials having strength characteristics similar to the metal alloys used to form the associated drill string.

API drill pipe threads 162*a* and 162*b* may be formed on the metal shank using standard threading techniques and procedures. Various components associated with sleeve 100 may be attached to exterior portions of the metal shank. Various techniques may be satisfactory used to attach the metal shank to other components of cylindrical body 110.

For some applications stabilizers 100 and/or 100*a* and associated rotary drill bit 50 may be preassembled and installed as a single unit with associated component 26*c* of bottom hole assembly 26. Slots 164 may function similar to bit breaker slots to engage and/or disengage stabilizer 100 and attached rotary drill bit 50 from adjacent component 26*c* of bottom hole assembly 26.

For embodiments such as shown in FIGS. 2-8, each blade 120 may include respective exterior surface 124 defined in part by uphole shoulder or uphole portion 121 and downhole shoulder or downhole portion 122. Sometimes respective exterior surfaces 124 may be designated 124*a*, 124*b*, 124*c* or 124*d* to help describe various features of the associated blade 120*a*, 120*b*, 120*c* or 120*d*. In a similar manner uphole portions 121, downhole portions 122, uphole edges 131 downhole edges 132 and contact surfaces or pads 140 may sometimes be designated 121*a*-121*d*, 122*a*-122*d*, 131*a*-131*d*, 132*a*-132*d* and/or 140*a*-140*d* to help describe various features of associated blades 120*a*-120*d*.

Each blade 120 may include respective uphole edge 131 disposed between respective uphole shoulder 121 and adjacent portions of respective exterior surface 124. Each blade 120 may also include respective downhole edge 132 disposed between respective downhole shoulder 122 and adjacent portions of respective exterior surface 124.

Each blade 120 may also include respective leading edge 128 and trailing edge 130. See FIGS. 2 AND 3. A respective primary fluid flow path 150 (which will be discussed later in more detail) may extend along the side of each blade 120 adjacent to leading edge 128. The side of each blade 120 adjacent to leading edge 128 may sometimes be described as a "lifting" surface. Another respective primary fluid flow path 150 may extend along the side of each blade 120 adjacent to trailing edge 130.

For embodiments such as shown in FIGS. 2-8, each blade 120 may be described as having a generally helical configuration relative to longitudinal axis 108. However, blades formed in accordance with teachings of the present disclosure may be formed on exterior portions of wells tools with a wide variety of configurations. The angle or orientation of blades 120 relative to longitudinal axis 108 may be modified in accordance with teachings of the present disclosure to provide optimum lifting of formation cuttings, downhole debris and/or fluids flowing flow from the end or bottom of an associated wellbore.

The configuration, dimensions and/or location of uphole shoulders 121, uphole edges 131, exterior surfaces 124, downhole edges 132 and/or downhole shoulders 122 may be varied substantially in accordance with teachings of the present disclosure. For example uphole shoulders 121 and/or downhole shoulders 122 may have more or less taper as compared with examples shown in FIGS. 2-8. Also, the taper of uphole shoulder 121*a* on blade 120*a* may vary substantially as compared with the taper of uphole shoulder 122*b* on adjacent blades 120*b* and/or the taper of uphole shoulder 122*d* of blade 120*d*. For embodiments such as shown in FIG. 5, uphole shoulders 121*a*, 121*b*, 121*c* and 121*d* may have substantially the same overall configuration, dimensions and taper. In a similar manner downhole shoulders 122*a*, 122*b*, 122*c* and 122*d* as shown in FIG. 6 may have substantially the same overall configuration, dimensions and taper.

For some applications uphole shoulders 121 and/or downhole shoulders 122 may have a more arcuate or curved configuration as compared with examples shown in FIGS. 2-8. For some applications uphole shoulders 121 may be substantially larger than associated downhole shoulders 122. Alternatively, uphole shoulders 121 may sometimes be substantially smaller than associated downhole shoulders 122.

In a similar manner uphole edges 131 and associated downhole edges 132 may sometimes be relatively sharp, well defined, or may sometimes have generally curved configurations to provide a more uniform or smooth transition between respective uphole portions 121 and/or downhole portions 122 and adjacent portions of associated exterior surface 124.

Teachings of the present disclosure allow substantially varying the configuration, dimensions and orientation of each blade disposed on exterior portions of a well tool including, but not limited to, associated uphole shoulders, downhole shoulders, exterior surfaces, uphole edges, downhole edges, leading edges and trailing edges to optimize fluid flow over exterior portions of the associated well tool.

Various fluid flow models and fluid flow software applications may be used to simulate resulting fluid flow characteristics. Flow restrictions or "pinch points" may be substantially reduced or eliminated by designing blades and associated fluid flow paths in accordance with teachings of the present disclosure and at the same time provide pads with relatively large surface areas operable to contact adjacent portions of a wellbore. Examples of such fluid flow models may include, but are not limited to, computational fluid dynamics (CFD) software programs, packages and/or applications. One example of a satisfactory CFD program is FLUENT, available from ANSYS, Inc. located in Canonsburg, Pa.

Respective pad or contact surface 140 may be formed on each blade 120 adjacent to associated uphole edge 131. See for example FIGS. 2, 3 and 4. Sometimes pads 140 may be designated 140*a*, 140*b*, 140*c* or 140*d* to help describe various features of associated blade 120*a*, 120*b*, 120*c* or 120*d*. For embodiments such as shown in FIGS. 2-8 each pad 140 may be generally described as having an enlarged surface area as compared with other portions of associated exterior surface 124. Various types of hardfacing and/or other hard materials (not expressly shown) may be disposed on exterior portions of each pad 140.

Each pad 140 may be defined in part by respective uphole edge 131 disposed generally adjacent to an associated upper portion 121. Pads 140 generally may also include respective downhole edge 142. For some applications each downhole edge 142 may be clearly defined such as downhole edges 142 as shown on blade 120*a* and 120*d* in FIG. 3. For other applications downhole edge 142 associated with one or more pads 140 may represent a more gradual change from trailing edge 130 of associated blade 120.

Pads 140 may include respective leading edge 144 and trailing edge 146 extending downhole from associated uphole edge 121. Leading edge 144 of each pad 140 may extend from corresponding leading edge 128 of associated blade 120. Trailing edge 146 of each pad 140 may extend from corresponding trailing edge 130 of associated blade 120.

Pads 140 may be designed in accordance with teachings of the present disclosure to provide optimum surface area to contact adjacent portions of a wellbore while steering or tilting associated rotary drill bit 50 to form a directional wellbore. For example, the width of each pad 140 proximate associated uphole edge 131 may be greater than the width of other portions of associated blade 120. The length of pad 140 between associated uphole edge 131 and associated downhole edge 142 may be approximately equal to the width of each pad 140 proximate associated uphole edge 131.

Pads 140 may function as fulcrum points for steering or directing rotary drill bit 50. Enlarging the surface area of each pad 140 as compared to other portions of associated blade 120 may provide improved steering control of rotary drill bit 50. For example the resulting enlarged surface area of each contact surface or pad 140 may engage or bear on inside diameter 31 of wellbore 30 proximate kickoff location 37 to steer or direct rotary drill bit 50 in a desired direction to form horizontal wellbore 30*a* without damaging or removing adjacent formation material.

Relatively large forces may be applied to uphole portions of each pad 140 during directional drilling of a wellbore when pads 140 function as a fulcrum point for directing rotary drill bit 50 attached to sleeve 100. For example at kickoff point 37 as shown in FIG. 1, most of the force required to steer rotary drill bit 50 in a desired direction to form wellbore 30*a* may be applied to the upper one third of pads 140 proximate associated uphole edge 131. The amount of force applied to pads 140 proximate associated downhole edge 142 may be very small or almost zero.

At least one blade formed on exterior portions of a well tool in accordance with teachings of the present disclosure may include a fluid flow path or channel extending through the blade. Each fluid flow path or channel may be defined in part by an interior surface of the blade and adjacent exterior portions of the well tool. Stabilizers 100 and 100*a* are only two examples of well tools which may be formed with blades and fluid flow paths or channels incorporating teachings of the present disclosure. For example, blades 27 disposed on exterior portions of component 26*c* of bottom hole assembly 26 may also be modified to include fluid flow paths and other features of the present disclosure.

The maximum total theoretical fluid flow area available over exterior portions of a well tool or downhole tool may correspond approximately with the difference or space between exterior portions of the well tool and the inside diameter of an associated wellbore such as inside diameter 31 of wellbore 30. Each blade 120 formed on exterior surface 116 of sleeves 100 and 100*a* reduces the total area available for fluid flow over exterior portions of respective generally cylindrical body 110. For embodiments such as shown in FIGS. 1-8 blades 120 may only reduce total available fluid flow area over exterior portions of respective sleeves 100 and 100*a* by approximately twenty-five percent (25%) as compared to the maximum total theoretical fluid flow area with no blades 120 disposed on exterior portions of generally cylindrical body 110 and at the same time provide substantially enlarged contact surfaces or pads 140 for use in steering an associated rotary drill bit.

Maintaining desired fluid flow rates and/or fluid flow volumes over exterior portions of a well tool or downhole tool may also improve the ability of associated drilling fluid to lift formation cuttings and debris, to clean cutting structures and exterior portions of an associated rotary drill bit. For example various features of sleeves 100 and 100*a* may enhance lifting of formation cuttings and debris from the end 36 or 36*a* of wellbores 30 or 30*a*. Teachings of the present disclosure may enhance cleaning of exterior portions of rotary drill bit 50 and clean or prevent buildup of formation cuttings and other downhole debris within fluid flow paths 150 or other exterior portions of sleeve 100 and 100*a*.

For embodiments such as shown in FIGS. 2-8, stabilizers 100 and 100*a* may include a plurality of fluid flow paths or channels 150. Each fluid flow path or channel 150 may include respective first portion or first segment 151 disposed between adjacent blades 120, respective second portion or second segment 152 extending through associated blade 120 and third portion or third segment 153 communicating with outlet 156 formed in uphole shoulder 121 of the associated blade 120.

For embodiments such as shown in FIGS. 2-8, each fluid flow path 150 may be generally described as having respective inlet 154 disposed between adjacent downhole shoulders 122 of associated blades 120. Each inlet 154 may also be described as a "common inlet" with respect to first segment 151, second segment 152 and third segment 153 of associated fluid flow path 150.

First portion or first segment 151 of each fluid flow path 150 may sometimes be referred to as an exterior fluid flow path or a primary fluid channel. First segment 151 of each fluid flow path 150 may be defined in part by portions of exterior surface 116 of generally cylindrical body 110 disposed between adjacent, associated blades 120. Each blade 120 may have a respective first segment 151 extending along opposite sides thereof.

Each first segment 151 may include respective inlet 154 disposed between respective downhole portions of associated blades 120. Each first segment 151 may also include respective outlet 155 disposed between respective pads or contact surfaces 140 on the associated blades 120. As a result of the increased surface area associated with pads or contact surfaces 140, the area of each inlet 154 may be larger than the area of outlet 155 for the associated first segment 151.

Second portion or second segment 152 of each fluid flow path 150 may sometimes be referred to as an auxiliary fluid flow path or auxiliary fluid channel operable to allow fluid communication between respective first portion or first segment 151 of fluid flow path 150 disposed proximate leading edge 128 of the associated blade 120 and respective first portion or first segment 151 of fluid flow path 150 disposed proximate trailing edge 130 of the associated blade 120. Fluid flowing through second segment 152 will generally enter associated fluid flow path 150 via respective inlet 154. Fluid flowing through second segment 152 may exit from outlet 155 disposed proximate the trailing edge of pad or contact surface 140 disposed on the associated blade 120.

Third portion or third segment 153 of each fluid flow path 150 may sometimes be referred to as an interior fluid channel or an interior fluid flow path operable to communicate fluid from associated second segment 152 to fluid outlet 156 formed in uphole portions of the associated blade 120. See for example respective shoulders 121. For some applications, the area of fluid outlet 156 may sometimes be larger than the area associated with fluid outlets 155 disposed adjacent to the leading edge and the trailing edge of the associated contact surface or pad 140.

One of the benefits of the present disclosure may include the ability to adjust the area associated with each outlet 155 and 156 and the area associated with each inlet 154 to optimize fluid flow over exterior portions of an associated well tool. For some applications the total fluid flow area associated with inlets 154 will be equal to or greater than the total fluid flow area associated with outlets 155 and 156. One or more blades (not expressly shown) which do not include as associated outlet 156 may also be disposed on exterior surfaces of a well tool incorporating teachings of the present disclosure.

Second segment 152 of each fluid flow path 150 may be defined in part by interior portions or interior surfaces 126 of associated blade 120 and adjacent portions of exterior surface 116 of sleeve 100 or 100*a*. See FIGS. 5, 6 and 8. Third segment or third portion 153 of each fluid flow path or channel 150 may be defined in part by interior portions 126 of associated blade 120, outlet 156 and adjacent portions of exterior surface 116 of sleeve 100 or 100*a*. See FIGS. 3, 5 and 8.

For some applications one or more blades may be formed on exterior portions of a well tool with two or more second segments or auxiliary flow paths (not expressly shown) extending therethrough. For example, at least one blade 120 may be formed with two respective second portions or second segments 152 (not expressly shown) extending therethrough. Each second segment 152 may have substantially similar dimensions and configurations or may have different configurations and dimensions. In a similar manner more than one third segment 153 (not expressly shown) may extend through at least one uphole shoulder 121. For other applications one or more blades may be formed on exterior portions of a well tool without any second segments or auxiliary flow paths (not expressly shown) extending therethrough to optimize fluid flow in accordance with teachings of the present disclosure.

Various features of the present disclosure may be described with respect to inlets 154*a*, 154*b*, 154*c* and 154*d*, outlets 155*a*, 155*b*, 155*c* and 155*d*, and outlets 156*a*, 156*b*, 156*c* and 156*d*. FIGS. 3, 4 and 6 shows inlet 154*a* disposed between downhole shoulder 122*d* and downhole shoulder 122*a*. Inlet 154*b* is shown disposed between downhole shoulder 122*a* and downhole shoulder 122*b*. Inlet 154*c* is shown disposed between downhole shoulder 122*b* and downhole shoulder 122*c*. Inlet 154*d* is shown disposed between downhole shoulder 122*c* and downhole shoulder 122*d*. Outlet 155*a* may be disposed between uphole shoulders 121*d* and uphole shoulder 121*a*. Outlet 155*b* is shown disposed between uphole shoulder 121*a* and uphole shoulder 121*b*. Outlet 155*c* is shown disposed between uphole shoulder 121*b* and uphole shoulder 121*c*. Outlet 155*d* is shown disposed between uphole shoulder 121*c* and uphole shoulder 121*d*. For embodiments such as shown in FIGS. 1-8 respective openings or outlets 156*a*, 156*b*, 156*c* and 156*d* may be formed in respective uphole portions 121*a*, 121*b*, 121*c* and 121*d*.

For some applications multiple outlets (not expressly shown) may be formed in each uphole portion 121*a*, 121*b*, 121*c* and 121*d*. Forming multiple channels or fluid flow paths extending through blades 120 and uphole portions 121 proximate associated pads 140 may allow the configuration, dimensions and/or location of associated pads 140 to be modified in accordance with teachings of the present disclosure to provide optimum bearing surfaces for contacting adjacent portions of a wellbore. Also, both fluid flow rates and total volume of fluid flowing over exterior portions of an associated well tool may be optimized as a result of forming multiple channels or fluid flow paths extending through one or more blades 120 and/or one or more pads 140.

For some embodiments the total fluid flow area associated with inlets 154*a*-154*d* may be approximately equal to the combined total fluid flow area associated with outlets 155*a*-155*d* and outlets 156*a*-156*d*. By providing approximately equal inlet areas and approximately equal outlet areas, resistance to fluid flow over exterior portions of generally cylindrical body 110 may be minimized. For other embodiments the total fluid flow area associated with inlets 154*a*-154*d* may be smaller than the combined total fluid flow area associated with outlets 155*a*-155*d* and outlets 15[5]6*a*-155*b*. For some downhole applications, increasing the total outlet fluid flow area relative to the total inlet fluid flow area may result in increased cleaning of exterior portions of an associated well tool.

For some applications outlets 155*a*-155*d* may be generally flared outwardly relative to respective first segment 151 of associated fluid flow path 150. For other applications outlets 151*a*-155*d* may be flared inwardly with respect to respective first segment 151 of associated fluid flow path 150. For still other applications outlets 155*a*-155*d* may alternately flare inwardly and outwardly relative to respective first segment 151 of associated fluid flow paths 150.

One of the benefits of the present disclosure may include the ability to modify the location, configuration and/or dimension of outlets 155 and 156 to provide optimum fluid flow rates, fluid flow volumes and/or pressure drops across exterior portions of generally cylindrical body 110. In a similar manner the configuration of inlets 154*a*-154*d* may flare outwardly, inwardly and/or may have an alternating configuration with respect to each other. The location, configuration and/or dimensions of inlets 154 and outlets 155 and 156 may be modified to maintain desired pressure drops and/or to create novel hydraulic effects to assist with lifting formation cuttings and/or other downhole debris from the bottom or end of an associated wellbore.

For some applications respective supporting structures may be disposed between interior surfaces of one or more blades and adjacent portions of an exterior surface of an associated well tool. See for example supporting structures 134 in FIGS. 4 and 7. Various finite element analysis (FEA) techniques and applications may be used to evaluate optimum wall thickness for portions of each blade 120 adjacent to associated interior fluid flow paths or auxiliary fluid channels 152 and/or 153. FEA techniques and applications may also be used to evaluate optimum surface area for pads or contact surfaces 140 based on anticipated forces applied during directional drilling of a wellbore and/or other forces associated with drilling a wellbore.

For embodiments represented by stabilizer 100*b* as shown in FIGS. 4 and 7, respective supporting structures 134 are shown disposed between interior surfaces 126 of associated blades 120 and adjacent portions of exterior surface 116 of generally cylindrical body 110. Supporting structures 134 may prevent deflection of associated blades 120 when heavy bearing loads are placed on respective pads 140, particularly during directional drilling of a wellbore.

The location, configuration and/or dimensions of supporting structures 134 may be varied in accordance with teachings of the present disclosure to minimize any resistance of fluid flow through associated second segment 152. For some applications supporting structures 134 may have the general configuration of a "fin" to minimize resistance to fluid flow. Dotted line 134 is shown in FIG. 2 to represent one possible location for adding supporting structures 134 to blades 120 of stabilizer 100 if such support is required for anticipated downhole conditions.

Although the present disclosure and its advantages have been described in detail, it should be understood that various changes, substitutions and alternations can be made herein without departing from the spirit and scope of the disclosure as defined by the following claims.

What is claimed is:

1. A sleeve comprising:

a first end and a second end with a longitudinal passageway extending through the sleeve between the first end and the second end;

a plurality of blades disposed on an exterior surface of the sleeve;

the blades spaced from each other to form respective fluid flow paths disposed between adjacent blades, the respective fluid flow paths operable to communicate a fluid in a generally uphole direction;

each blade having an exterior surface spaced radially from adjacent portions of the sleeve;

a respective pad formed on the exterior surface of the at least one blade adjacent to an uphole portion of the at least one blade;

each respective pad having an enlarged exterior surface as compared with the adjacent exterior surface of the associated blade;

at least one blade having at least one channel extending through the blade;

the channel operable to communicate with fluid flow paths disposed adjacent to the at least one blade at least one supporting structure disposed in the channel extending through the at least one blade; and each supporting structure extending between the interior surface of the at least one blade and adjacent portions of the exterior surface of the sleeve.

2. The sleeve of claim 1 further comprising:

a generally cylindrical body with the blades disposed on exterior portions of the generally cylindrical body; and the channel extending through the at least one blade defined in part by an interior surface of the blade disposed opposite from the exterior surface of the blade and portions of the exterior surface of the generally cylindrical body spaced from the interior surface of the blade.

3. The sleeve of claim 2 further comprising a supporting structure disposed within the channel of the at least one blade extending between the interior surface of the at least one blade and the exterior surface of the generally cylindrical body.

4. The sleeve of claim 1 further comprising each pad operable to function as a fulcrum during directional drilling of a wellbore.

5. The sleeve of claim 1 further comprising:

the at least one supporting structure having the general configuration of a fin; and each fin oriented to minimize any restriction to fluid flow through the associated channel.

6. The sleeve of claim 1 wherein the fluid flow paths disposed on exterior portions of the sleeve further comprises:

each fluid flow path having a first segment disposed between adjacent blades; and each fluid flow path having a respective second segment extending through one of the associated blades.

7. The sleeve of claim 6 wherein each fluid flow path further comprises a respective third segment exiting from an outlet disposed in an uphole portion of the associated blade.

8. The sleeve of claim 1 further comprising:

each blade having a respective channel extending therethrough;

each blade having a respective uphole portion and a respective downhole portion;

the downhole portion of each blade spaced from the downhole portions of the adjacent blades;

each fluid flow path formed between the adjacent blades having an inlet portion;

the inlet portion of each fluid flow path defined in part by the spacing between the respective downhole portions of the adjacent blades;

a respective first outlet portion for each fluid flow path defined in part by spacing between the uphole portions of the adjacent blades;

each channel extending through the respective blade having a respective second outlet portion; and the total area of the inlet portions of each fluid flow path approximately equal to the total area of the first outlet portions and the second outlet portions.

9. The sleeve of claim 1 further comprising:

each fluid flow path having an inlet;

each fluid flow path having a first outlet;

each fluid flow path having a second outlet; and the total area of the first outlets and the second outlets equal to or greater than the total area of the inlets.

10. A stabilizer comprising:

a first end and a second end with a longitudinal passageway extending through the stabilizer from the first end to the second end;

a plurality of blades disposed on exterior portions of the stabilizer;

the blades spaced from each other to form respective fluid flow paths disposed between adjacent blades, the respective fluid flow paths operable to communicate a fluid in a generally uphole direction;

each blade having a respective uphole shoulder and a respective downhole shoulder, the uphole shoulder and the downhole shoulder of each blade spaced from the respective uphole shoulders and downhole shoulders of the adjacent blades;

respective exterior fluid flow paths formed between adjacent blades, each exterior fluid flow path having an inlet portion defined in part by spacing between the downhole shoulders of the associated blades and a first outlet portion defined in part by spacing between the uphole shoulders of the associated blades;

each blade having a respective interior fluid flow path extending therethrough, the interior fluid flow path extending through each blade operable to communicate flow between the exterior fluid flow paths disposed on opposite sides of each blade;

each interior fluid flow path defined in part by an interior surface of the respective blade;

each interior flow path further defined by associated exterior portions of the stabilizer;

a respective contact surface formed on an exterior portion of each blade adjacent to an uphole edge of the associated blade;

each respective contact surface having an enlarged exterior surface as compared with the adjacent exterior surface of the associated blade; and each contact surface operable to function as a fulcrum during directional drilling of a wellbore.

11. A bottom hole assembly including a stabilizer and a rotary drill operable to form a wellbore comprising:

at least one component of the bottom hole assembly operable to direct movement of the rotary drill to form a directional wellbore;

the stabilizer including a generally cylindrical body having a first end and a second end with a longitudinal passageway extending through the generally cylindrical body from the first end to the second end;

at least three blades disposed on exterior portions of the generally cylindrical body;

the at least three blades spaced from each other to form respective fluid flow paths disposed between adjacent blades, the respective fluid flow paths operable to communicate a fluid in a generally uphole direction;

each blade having a respective uphole portion and a respective downhole portion, the downhole portion of each blade spaced from respective downhole portions of the adjacent blades;

a respective exterior fluid channel formed between each pair of adjacent blades, each exterior fluid channel having an inlet defined in part by spacing between the respective downhole portions of the associated blades and a first outlet defined in part by the spacing between the uphole portion of the associated blades;

each blade having a respective auxiliary fluid channel extending therethrough, the respective auxiliary fluid channel extending through the blades having a respective second outlet;

each auxiliary fluid channel defined in part by an interior surface of the respective blade;

each auxiliary fluid channel further defined by associated exterior portions of the generally cylindrical body;

the total area of the first outlets and the second outlets greater than the total area of the inlets;

the rotary drill bit releasably engaged with the second end of the stabilizer; and a respective pad formed on an exterior portion of each blade adjacent to an uphole edge of the associated blade;

each respective pad having an enlarged exterior surface as compared with the adjacent exterior surface of the associated blade; and wherein the pad is operable to function as a fulcrum during directional drilling of a wellbore.

12. The bottom hole assembly of claim 11 wherein the stabilizer further comprises each blade having a generally helical configuration.

13. The bottom hole assembly of claim 11 wherein the stabilizer further comprises:

each blade having a respective uphole shoulder and a respective downhole shoulder;

the downhole shoulder of each blade spaced from respective downhole shoulders of adjacent blades;

respective exterior fluid channels formed between adjacent blades;

each exterior fluid channel having an inlet portion and a first outlet portion;

the inlet portion of each exterior fluid channel defined in part by the distance between the downhole shoulders of the associated blades;

the outlet portion of each exterior fluid channel path defined in part by the spacing between the uphole shoulders of the associated blades;

the auxiliary fluid channel extending through each blade having a respective second outlet portion; and the total flow area of the inlet portions approximately equal to the total flow area of the first outlet portions and the second outlet portions.

14. The bottom hole assembly of claim 11 wherein the stabilizer further comprises four blades spaced from each other and disposed on exterior portions of the generally cylindrical body.

15. A near bit stabilizer comprising:

a generally cylindrical body having a first end and a second end with a longitudinal passageway extending through the generally cylindrical body;

a plurality of blades disposed on an exterior surface of the generally cylindrical body;

the blades spaced from each other to form respective fluid flow paths between adjacent blades;

each blade having an exterior surface spaced radially from adjacent portions of the generally cylindrical body;

at least one blade having at least one channel extending through the blade to accommodate fluid flow therethrough;

a respective contact surface formed on the exterior surface of at least one blade adjacent to an uphole portion of the at least one blade; and each respective contact surface having an enlarged surface area as compared with the adjacent exterior surface of the at least one blade.

16. A method of manufacturing a well tool comprising:

forming the well tool with a first end and a second end with a longitudinal passageway extending through the well tool from the first end to the second end;

forming a plurality of blades disposed on and extending from exterior portions of the well tool with the blades spaced from each other to form respective primary fluid flow paths disposed therebetween so that respective primary fluid flow paths extend along opposite sides of each blade;

forming each blade with a respective uphole portion and a respective downhole portion;

forming a fluid inlet disposed between adjacent downhole portions of each blade and forming a first fluid outlet disposed between adjacent uphole portions of each blade;

forming at least one blade with an auxiliary fluid flow path extending therethrough to allow communication of fluid flow between the respective primary fluid flow path disposed on one side of the at least one blade and the respective primary fluid flow path disposed on the other side of the at least one blade;

forming at least a second fluid outlet extending through the uphole portion of the at least one blade;

forming an internal fluid passageway within the at least one blade operable to communicate fluid flow from the auxiliary fluid flow path with the second fluid outlet extending through the uphole portion thereof; and forming an enlarged contact surface on the uphole portion of at least one of the blades.

17. The method of claim 16 further comprising forming the fluid inlets with a total fluid flow area approximately equal to a total fluid area of the fluid outlets.

18. The method of claim 16 further comprising forming the fluid outlets with a total fluid flow area greater than the total fluid flow area of the fluid inlets.

* * * * *